US008183968B2

(12) United States Patent
Tsai et al.

(10) Patent No.: US 8,183,968 B2
(45) Date of Patent: May 22, 2012

(54) BOBBIN OF TRANSFORMER

(75) Inventors: Hsin-Wei Tsai, Taoyuan Hsien (TW); Yi-Lin Chen, Taoyuan Hsien (TW); Ching-Hsing Tien, Taoyuan Hsien (TW); Ti-Chin Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/045,266

(22) Filed: Mar. 10, 2011

(65) Prior Publication Data

US 2011/0221562 A1 Sep. 15, 2011

(30) Foreign Application Priority Data

Mar. 12, 2010 (TW) ..... 99107309 A

(51) Int. Cl.
*H01F 27/30* (2006.01)

(52) U.S. Cl. ..... 336/198

(58) Field of Classification Search ..... 336/65, 336/83, 192, 196, 198, 200, 206–208
See application file for complete search history.

(56) References Cited

U.S. PATENT DOCUMENTS

| | | | | |
|---|---|---|---|---|
| 6,208,232 | B1 * | 3/2001 | Chen | 336/192 |
| 7,167,069 | B2 * | 1/2007 | Haga | 336/198 |
| 7,183,889 | B2 * | 2/2007 | Fushimi | 336/208 |
| 7,345,565 | B2 * | 3/2008 | Yang et al. | 336/200 |
| 2002/0017975 | A1 * | 2/2002 | Chiang et al. | 336/198 |
| 2002/0070832 | A1 * | 6/2002 | Yeh et al. | 336/192 |
| 2008/0211616 | A1 * | 9/2008 | Suzuki et al. | 336/182 |
| 2009/0108976 | A1 * | 4/2009 | Nerone et al. | 336/192 |

* cited by examiner

*Primary Examiner* — Tuyen Nguyen
(74) *Attorney, Agent, or Firm* — Kirton McConkie; Evan R. Witt

(57) ABSTRACT

A bobbin of a transformer includes a main body and plural connecting bases. The main body has two side plates. The two side plates are respectively disposed on two opposite sides of the main body. A winding section is defined within the two side plates for winding a winding coil. The plural connecting bases are disposed on the two opposite sides of the main body and connected with the side plates. Plural wire-arranging grooves are formed in a bottom surface of each connecting base. Each side plate has an inner recess in communication with a corresponding wire-arranging groove. An initial winding segment of the winding coil is accommodated within the wire-arranging groove and the inner recess, thereby preventing the winding coil from rubbing against the initial winding segment during the winding coil is wound on the winding section.

9 Claims, 7 Drawing Sheets

BOBBIN OF TRANSFORMER

FIELD OF THE INVENTION

The present invention relates to a bobbin, and more particularly to a bobbin of a transformer.

BACKGROUND OF THE INVENTION

A transformer has become an essential electronic component for regulating an input voltage into voltages required for various kinds of electric appliances.

FIG. 1A is a schematic exploded view illustrating a conventional transformer. As shown in FIG. 1A, the transformer 1 comprises a bobbin 11, a covering member 12, and a magnetic core assembly 13. A primary winding coil 111 and a secondary winding coil 112 are wound on the bobbin 11. The outlet terminals 113, 114 of the primary and the secondary winding coils 111, 112 are directly wound and soldered on the connecting parts 117 of the pins 118. The insertion parts 115 of the pins 118 are inserted into conductive holes of a system circuit board (not shown). The covering member 12 is used for partially sheltering the upper portion of the bobbin 11 in order to increase the creepage distances between the primary winding coil 111, the secondary winding coil 112 and the magnetic core assembly 13. The magnetic core assembly 13 includes middle portions 131 and leg portions 132. The middle portions 131 are accommodated within a channel 116 of the bobbin 11. The bobbin 11 is partially enclosed by the leg portions 132. Meanwhile, the transformer 1 is assembled.

Please refer to FIG. 1A again. The transformer 1 is electrically connected with the system circuit board through the connecting parts 117 and the insertion parts 115 of the pins 118. Since each pin 118 includes a connecting part 117 and an insertion part 115, the pin 118 is L-shaped. The outlet terminals 113 and 114 are wound and soldered on the connecting parts 117. Via the connecting parts 117 and the insertion parts 115, the outlet terminals 113 and 114 are electrically connected with the system circuit board. Although the L-shaped pins 118 are effective for electrically connecting the outlet terminals 113 and 114 with the system circuit board, there are still some drawbacks. For example, during the transformer 1 is mounted on the system circuit board, the L-shaped pins 118 are readily shifted. In this situation, the outlet terminals 113 and 114 are possibly broken and detached from the connecting parts 117. As known, the increase of wire diameter of the primary winding coil 111 and the secondary winding coil 112 may reduce the possibility of breaking the outlet terminals 113 and 114. However, since the wire diameter is increased, the turn numbers of the primary winding coil 111 and the secondary winding coil 112 may be insufficient to achieve the required inductance. For complying with the increased wire diameter, the bobbin 11 needs to be re-designed and re-produced. The process of re-designing and re-producing the new bobbin is time-consuming and costly.

Moreover, since the connecting parts 117 of the L-shaped pins 118 are arranged at the same level and adjacent to each other, the outlet terminals 113 and 114 soldered on the connecting parts 117 are readily contacted with each other. In this situation, a short-circuited problem occurs.

FIG. 1B is a schematic assembled and rear view illustrating the transformer of FIG. 1A. For winding the primary winding coil 111 on the bobbin 11, an outlet terminal of the primary winding coil 111 is firstly soldered on a connecting part 117 of a pin 118. Then, the primary winding coil 111 is partially accommodated within the wire-arranging groove 119. Then, the primary winding coil 111 is wound around the winding section of the bobbin 11. The process of winding the secondary winding coil 112 on the bobbin 11 is similar to the process of winding the primary winding coil 111 on the bobbin 11, and is not redundantly described herein.

Please refer to FIG. 1B again. Since the remaindering winding coil may frequently rub against an initial winding segment 1111 of the primary winding coil 111 during the winding coil is wound on the first winding section, the insulated varnish (not shown) coated on the initial winding segment 1111 of the primary winding coil 111 is possibly abraded off. In this situation, the insulating efficacy of the primary winding coil 111 is insufficient, and thus an instantaneous spike problem occurs.

Therefore, there is a need of providing an improved bobbin of a transformer so as to obviate the drawbacks encountered from the prior art.

SUMMARY OF THE INVENTION

It is an object of the present invention to provide a bobbin of a transformer without causing the short-circuited problem and the instantaneous spike problem.

In accordance with an aspect of the present invention, there is provided a bobbin of a transformer. The bobbin includes a main body and plural connecting bases. The main body has two side plates. The two side plates are respectively disposed on two opposite sides of the main body. A winding section is defined within the two side plates for winding a winding coil. The plural connecting bases are disposed on the two opposite sides of the main body and connected with the side plates. Plural wire-arranging grooves are formed in a bottom surface of each connecting base. At least one of the side plates has an inner recess in communication with a corresponding wire-arranging groove. An initial winding segment of the winding coil is accommodated within the wire-arranging groove and the inner recess, thereby preventing the winding coil from rubbing against the initial winding segment during the winding coil is wound on the winding section.

In accordance with another aspect of the present invention, there is provided a bobbin of a transformer. The bobbin includes a main body, plural connecting bases, at least one conducting pin and at least one auxiliary pin. The main body has two side plates. The two side plates are respectively disposed on two opposite sides of the main body. A winding section is defined within the two side plates for winding a winding coil. The plural connecting bases are disposed on the two opposite sides of the main body and connected with the side plates. Plural wire-arranging grooves are formed in a bottom surface of each connecting base. At least one of the side plates has an inner recess in communication with a corresponding wire-arranging groove. The conducting pin is partially buried in a corresponding connecting base. The conducting pin includes a connecting part and an insertion part vertical to the connecting part. The insertion part is vertically extended from the connecting base. The auxiliary pin is disposed on the connecting base, and adjacent to and in parallel with the connecting part of the conducting pin. An outlet terminal of the winding coil is firstly wound on the auxiliary pin and then wound on the connecting part of the conducting pin. An initial winding segment of the winding coil is accommodated within the wire-arranging groove and the inner recess, thereby preventing the winding coil from rubbing against the initial winding segment during the winding coil is wound on the winding section.

In accordance with a further aspect of the present invention, there is provided a bobbin of a transformer. The bobbin includes a main body, a first connecting base, a second connecting base, plural conducting pins and plural auxiliary pins. The main body has a first side plate and a second side plate. The first side plate and the second side plate are respectively disposed on two opposite sides of the main body. A winding section is defined within the first side plate and the second side plate for winding a winding coil. The first connecting base is disposed at a first side of the main body and connected with the first side plate. Plural wire-arranging grooves are formed in a bottom surface of the first connecting base. The first side plate has an inner recess in communication with a corresponding wire-arranging groove. The second connecting base is disposed at a second side of the main body and connected with the second side plate. The plural conducting pins are partially buried in the first connecting base and the second connecting base. Each of the conducting pins includes a connecting part and an insertion part vertical to the connecting part. The insertion part is vertically extended from a corresponding connecting base. The plural auxiliary pins are disposed on the first connecting base, and adjacent to and in parallel with the connecting part of the conducting pin. An outlet terminal of the winding coil is firstly wound on the auxiliary pin and then wound on the connecting part of the conducting pin. An initial winding segment of the winding coil is accommodated within the wire-arranging groove and the inner recess, thereby preventing the winding coil from rubbing against the initial winding segment during the winding coil is wound on the winding section. The second connecting base includes plural connecting surfaces. The connecting parts of the conducting pins are extended from respective connecting surfaces. Every two adjacent connecting surfaces are non-coplanar so that every two adjacent connecting parts are arranged on non-coplanar connecting surfaces of the second connecting base.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
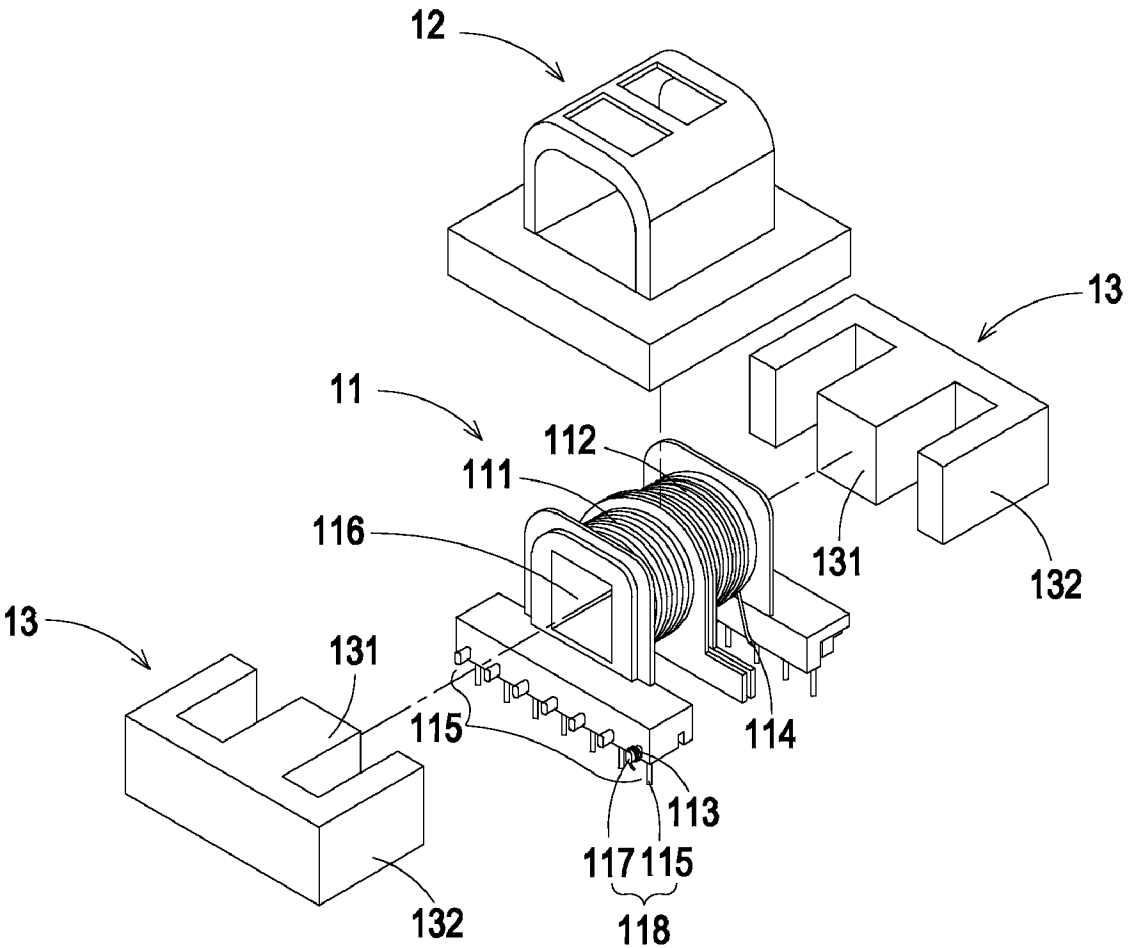
FIG. 1A PRIOR ART
FIG. 1A is a schematic exploded view illustrating a conventional transformer.
Figure 1B:
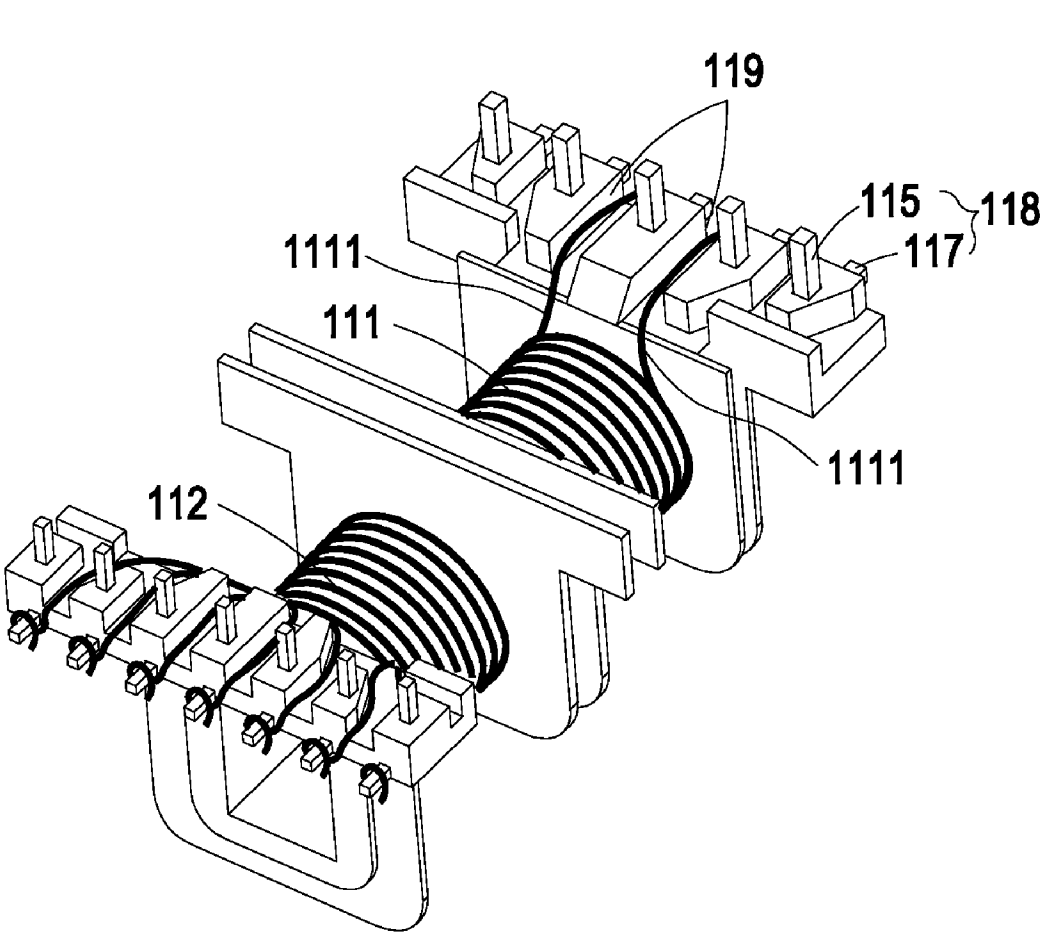
FIG. 1B PRIOR ART
FIG. 1B is a schematic assembled and rear view illustrating the transformer of FIG. 1A.
Figure 2:
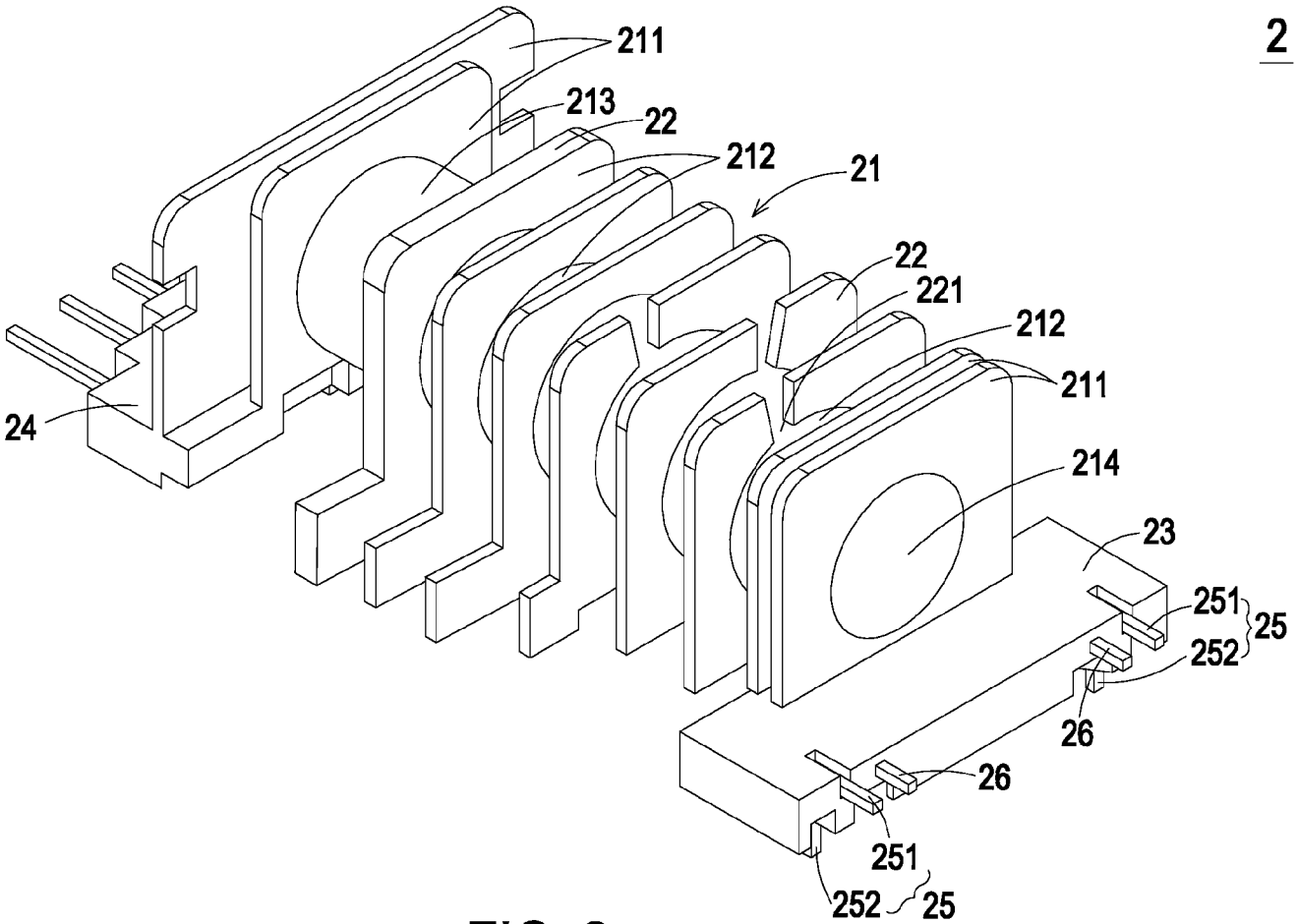
FIG. 2 is a schematic perspective view illustrating a bobbin of a transformer according to an embodiment of the present invention.

FIG. 2 is a schematic perspective view illustrating a bobbin of a transformer according to an embodiment of the present invention. The bobbin 2 is used for winding a winding coil 3 (e.g. a primary winding coil or a secondary winding coil). The winding coil 3 has an outlet terminal 31 and an initial winding segment 32 (see FIG. 3B). As shown in FIG. 2, the bobbin 2 comprises a main body 21, a first connecting base 23, a second connecting base 24, at least one conducting pin 25 and an auxiliary pin 26. Two side plates 211 are respectively disposed on two opposite sides of the main body 21. Plural partition plates 22 are arranged between the two side plates 211. These partition plates 22 are substantially in parallel with the side plates 211. By the side plates 211 and the partition plates 22, plural first winding sections 212 and a second winding section 213 are defined on the main body 21. The winding coil 3 is wound on the first winding sections 212 and the second winding section 213. The plural first winding sections 212 are in communication with each other through the notches 221 of the partition plates 22. For example, the first winding sections 212 are used as a primary side of the transformer for winding the primary winding coil. The second winding section 213 is used as a secondary side of the transformer for winding the secondary winding coil. Moreover, the bobbin 2 has a channel 214 running through the side plates 211 and the main body 21. A magnetic core assembly (not shown) of the transformer 2 is partially accommodated within the channel 214 of the bobbin 2.

Figure 3A:
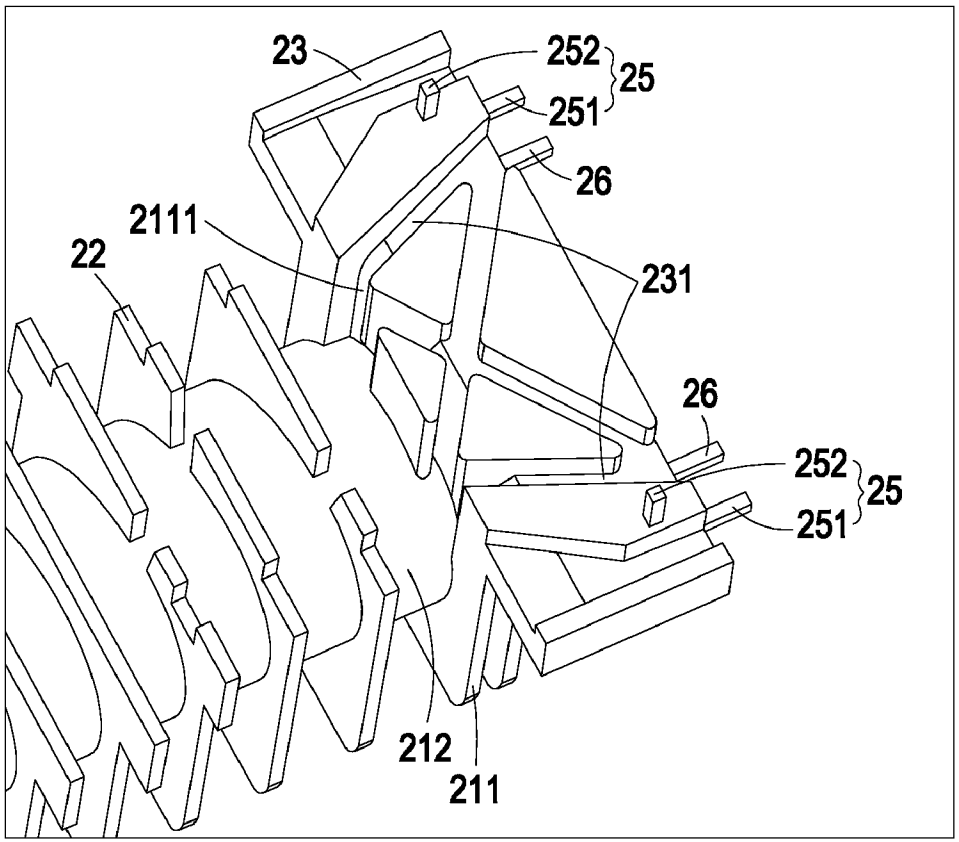
FIG. 3A is a schematic rear view illustrating the first connecting base and a portion of the main body of the bobbin as shown in FIG. 2.

FIG. 3A is a schematic rear view illustrating the first connecting base and a portion of the main body of the bobbin as shown in FIG. 2. Please refer to FIGS. 2 and 3A. The first connecting base 23 is disposed at a first side of the main body 21 and connected with a corresponding side plate 211. Plural wire-arranging grooves 231 are formed in the bottom surface of the first connecting base 23. An inner recess 2111 is formed in the side plate 211, and ranged between the first winding section 212 and the first connecting base 23. The inner recess 2111 is in communication with the wire-arranging groove 231. Plural conducting pins 25 are partially buried in the first connecting base 23 and the second connecting base 24. In this embodiment, the conducting pins 25 are L-shaped. Each of the conducting pins 25 includes a connecting part 251 and an insertion part 252. The connecting part 251 and the insertion part 252 are perpendicular to each other. The insertion part 252 is partially buried in a corresponding connecting base and vertically extended from the bottom surface of the connecting base. The insertion part 252 is inserted into a corresponding conductive hole of a system circuit board (not shown). The connecting part 251 is partially buried in a corresponding connecting base and horizontally extended from the connecting base. The outlet terminal 31 of the winding coil 3 is wound around the connecting part 251. In addition, plural auxiliary pins 26 are buried in the first connecting base 23 by insertion. The auxiliary pins 26 are arranged adjacent to and parallel with the connecting parts 251 of the conducting pins 25.

Figure 3B:
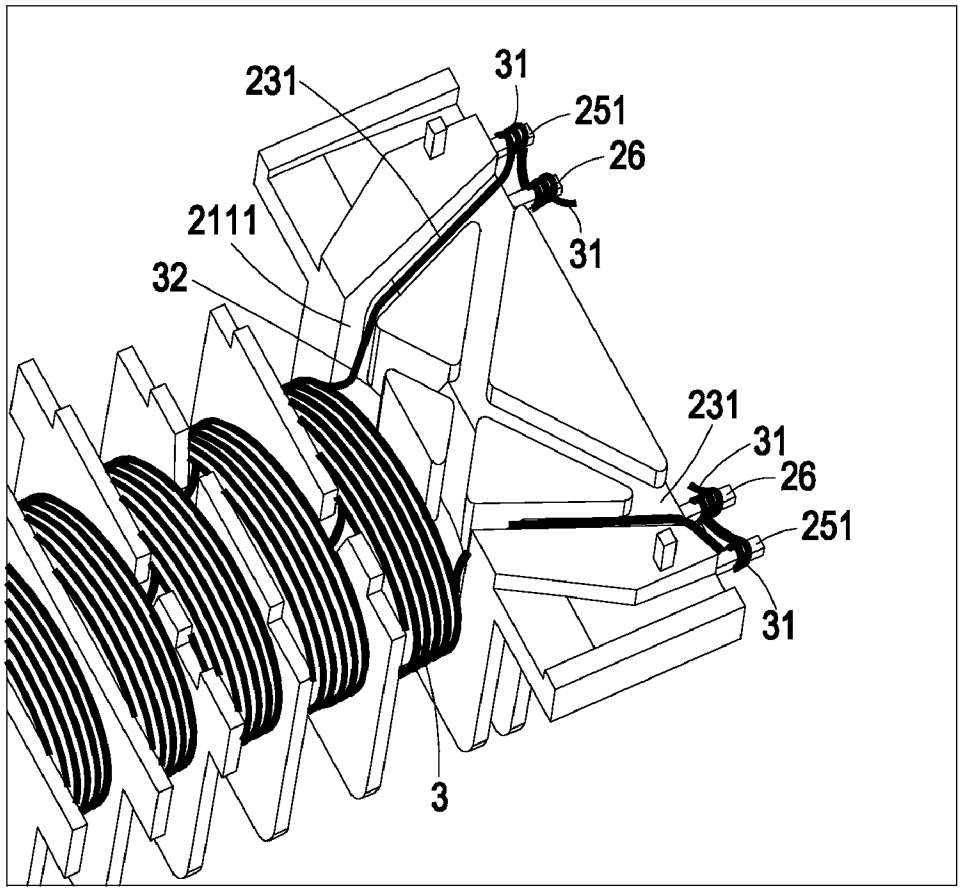
FIG. 3B is a schematic rear view illustrating the first connecting base and a portion of the main body of the bobbin as shown in FIG. 2, in which a winding coil is wound on the bobbin.

FIG. 3B is a schematic rear view illustrating the first connecting base and a portion of the main body of the bobbin as shown in FIG. 2, in which a winding coil is wound on the bobbin. Hereinafter, a process of winding the winding coil 3 on the bobbin 2 will be illustrated with reference to FIGS. 3A and 3B. Firstly, the outlet terminal 31 of the winding coil 3 is wound on the auxiliary pin 26 and wound on the connecting part 251 of the conducting pin 25. Then, the winding coil 3 is partially accommodated within the wire-arranging groove 231 and the inner recess 2111, and then wound on the first winding section 212. As such, the initial winding segment 32 is accommodated within the wire-arranging groove 231 and the inner recess 2111. Since the initial winding segment 32 of the winding coil 3 is accommodated within the inner recess 2111, the possibility of rubbing the remaindering winding coil 3 against the initial winding segment 32 during the winding coil 3 is wound on the first winding section 212 will be minimized or eliminated. As a consequence, the drawbacks encountered from the prior art will be overcome.

Moreover, since the outlet terminal 31 of the winding coil 3 is firstly wound on the auxiliary pin 26 and then wound on the connecting part 251 of the conducting pin 25, the auxiliary pin 26 can facilitate fixing the outlet terminal 31 of the winding coil 3. Even if the L-shaped pin 25 is shifted during the mounting process, the possibility of breaking the outlet terminal 31 of the winding coil 3 is minimized or eliminated. Moreover, solder paste may be applied on the auxiliary pin 26 and the connecting part 251 of the conducting pin 25 so that the outlet terminal 31 of the winding coil 3 is securely fixed on the auxiliary pin 26 and the connecting part 251 of the conducting pin 25.

Figure 4:
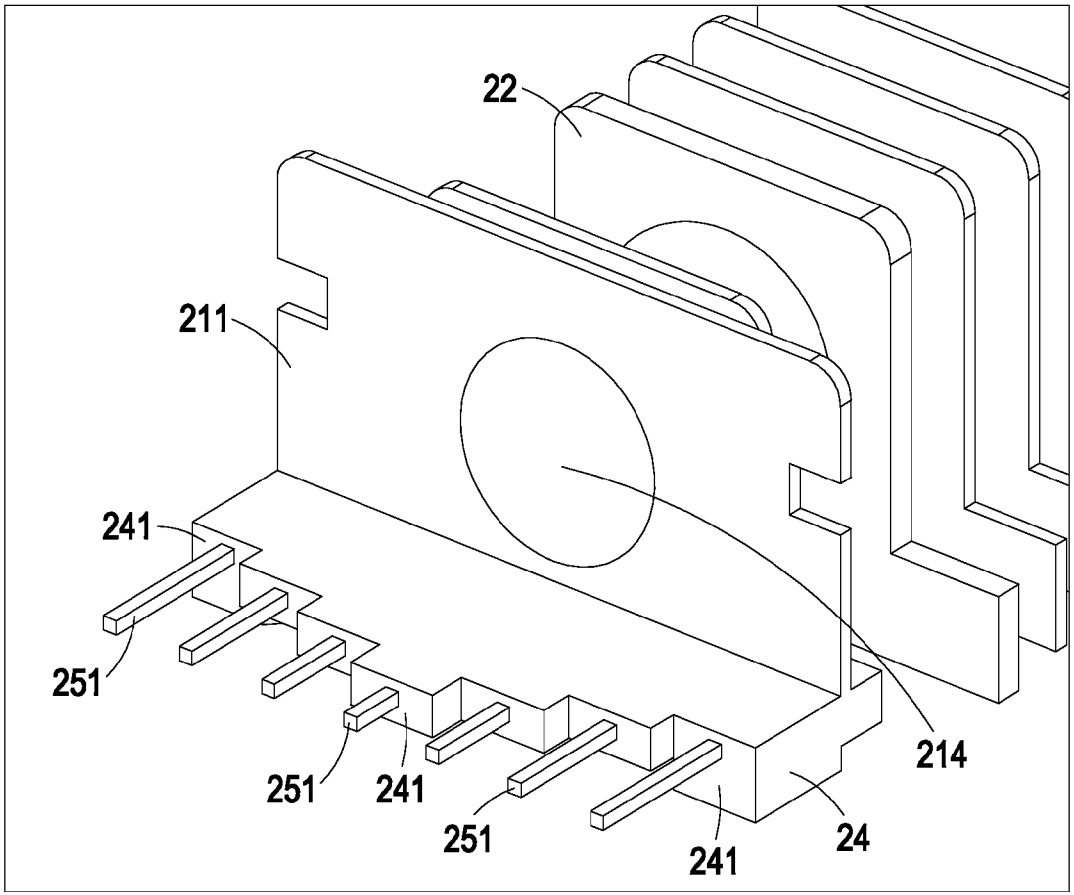
FIG. 4 is a schematic perspective view illustrating the second connecting base and a portion of main body of the bobbin as shown in FIG. 2.

FIG. 4 is a schematic perspective view illustrating the second connecting base and a portion of main body of the bobbin as shown in FIG. 2. Please refer to FIGS. 2 and 4. The second connecting base 24 is disposed at a second side of the main body 21 and connected with a corresponding side plate 211. The second connecting base 24 comprises plural connecting surfaces 241. The connecting parts 251 of the conducting pins 25 are extended from the connecting surfaces 241. In this embodiment, every two adjacent connecting surfaces 241 are non-coplanar. For example, the connecting surfaces 241 are arranged in multiple steps. Since every two adjacent connecting parts 251 of the conducting pins 25 are arranged on non-coplanar surfaces of the second connecting base 24, the outlet terminals wound on the adjacent connecting parts 251 will no longer be contacted with each other.

Figure 5:
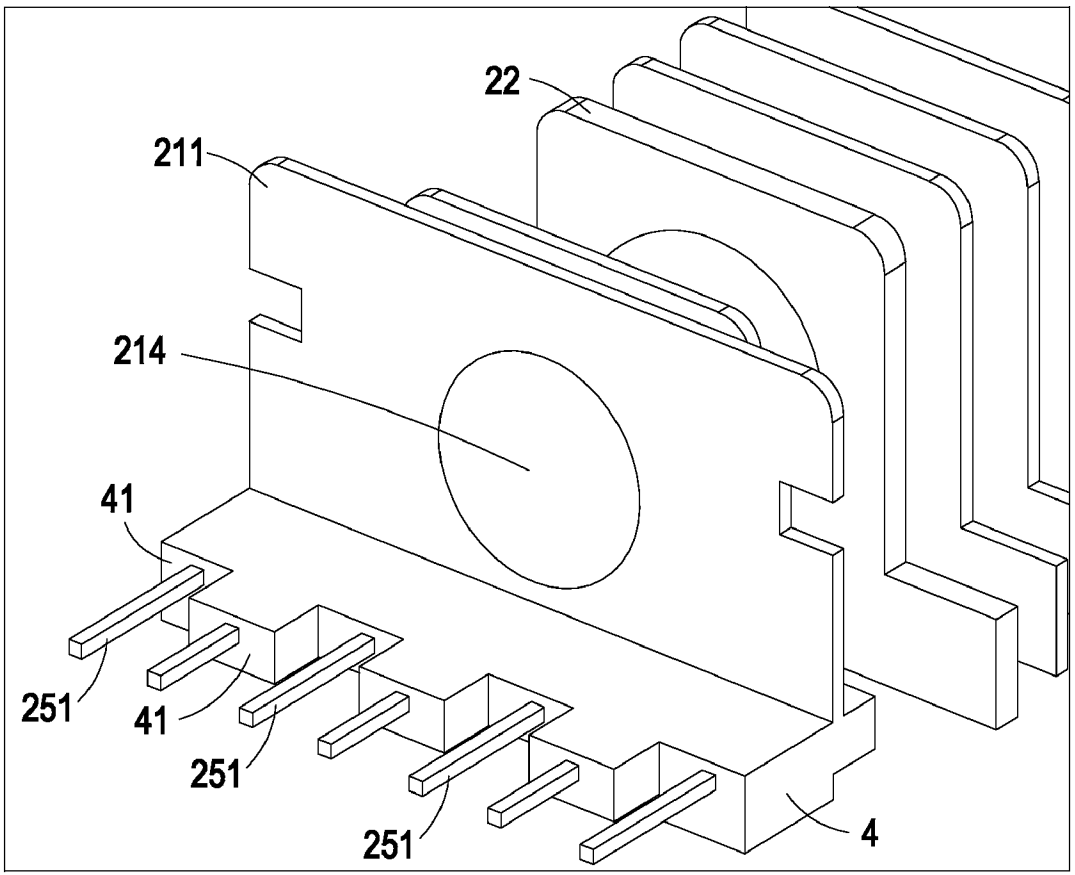
FIG. 5 is a schematic perspective view illustrating another exemplary second connecting base of the bobbin according to the present invention.

FIG. 5 is a schematic perspective view illustrating another exemplary second connecting base of the bobbin according to the present invention. In this embodiment, the second connecting base 4 comprises alternate concave and convex connecting surfaces 41. The configurations of the connecting surfaces are not restricted to the embodiments of FIGS. 4 and 5 as long as every two adjacent connecting parts 251 of the conducting pins 25 are arranged on non-coplanar surfaces of the second connecting base.

It is noted that, however, those skilled in the art will readily observe that numerous modifications and alterations may be made while retaining the teachings of the invention. For example, the first connecting base 23 of the bobbin 2 may include plural connecting surfaces, and every two adjacent connecting surfaces are non-coplanar. In addition, plural auxiliary pins 26 may be disposed beside the connecting parts 251, which are disposed on the second connecting base 24, and the outlet terminal 31 of the winding coil 3 may be wound on a corresponding auxiliary pin 26. In addition, plural wire-arranging grooves may be formed in the bottom surface of the second connecting base 24, and an inner recess may be formed in the side plate adjacent to the second connecting base 24.

From the above description, since the initial winding segment of the winding coil is accommodated within the inner recess of the bobbin, the possibility of rubbing the remaindering winding coil against the initial winding segment during the winding coil is wound on the bobbin will be minimized or eliminated. Since the outlet terminal of the winding coil is firstly wound on the auxiliary pin and then wound on the connecting part of the conducting pin, the auxiliary pin can facilitate fixing the outlet terminal of the winding coil and the possibility of breaking outlet terminal is minimized or eliminated. Moreover, since every two adjacent connecting parts of the conducting pins are arranged on non-coplanar surfaces of the second connecting base, the outlet terminals wound on the adjacent connecting parts will no longer be contacted with each other. In this situation, the possibility of causing the short-circuited problem is minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A bobbin of a transformer, said bobbin comprising:

a main body having two side plates, which are respectively disposed on two opposite sides of said main body, wherein a winding section is defined within said two side plates for winding a winding coil;

plural connecting bases disposed on said two opposite sides of said main body, and connected with said side plates, wherein plural wire-arranging grooves are formed in a bottom surface of each connecting base, and at least one of said side plates has an inner recess in communication with a corresponding wire-arranging groove;

at least one conducting pin partially buried in a corresponding connecting base, wherein said conducting pin includes a connecting part and an insertion part vertical to said connecting part, and said insertion part is vertically extended from said connecting base; and at least one auxiliary pin disposed on said connecting base, and adjacent to and in parallel with said connecting part of said conducting pin, wherein an outlet terminal of said winding coil is firstly wound on said auxiliary pin and then wound on said connecting part of said conducting pin, and an initial winding segment of said winding coil is accommodated within said wire-arranging groove and said inner recess, thereby preventing said winding coil from rubbing against said initial winding segment during said winding coil is wound on said winding section.

2. The bobbin according to claim 1, wherein said bobbin further comprises a partition plate, said partition plate is disposed on said main body, and said partition plate and said side plates define said winding section.

3. The bobbin according to claim 2, wherein said partition plate is substantially parallel with said side plates.

4. The bobbin according to claim 1, wherein said bobbin further comprises a channel running through said side plates and said main body.

5. The bobbin according to claim 1, wherein said auxiliary pin is partially buried in a corresponding connecting base by insertion.

6. The bobbin according to claim 1, wherein said insertion part of said conducting pin is disposed on a system circuit board.

7. A bobbin of a transformer, said bobbin comprising:

a main body having a first side plate and a second side plate, which are respectively disposed on two opposite sides of said main body, wherein a winding section is defined within said first side plate and said second side plate for winding a winding coil;

a first connecting base disposed at a first side of said main body and connected with said first side plate, wherein plural wire-arranging grooves are formed in a bottom surface of said first connecting base, and said first side plate has an inner recess in communication with a corresponding wire-arranging groove;

a second connecting base disposed at a second side of said main body and connected with said second side plate;

plural conducting pins partially buried in said first connecting base and said second connecting base, wherein each of said conducting pins includes a connecting part and an insertion part vertical to said connecting part, and said insertion part is vertically extended from a corresponding connecting base; and plural auxiliary pins disposed on said first connecting base, and adjacent to and in parallel with said connecting part of said conducting pin, wherein an outlet terminal of said winding coil is firstly wound on said auxiliary pin and then wound on said connecting part of said conducting pin, and an initial winding segment of said winding coil is accommodated within said wire-arranging groove and said inner recess, thereby preventing said winding coil from rubbing against said initial winding segment during said winding coil is wound on said winding section, wherein said second connecting base comprises plural connecting surfaces, said connecting parts of said conducting pins are extended from respective connecting surfaces, and every two adjacent connecting surfaces are non-coplanar so that every two adjacent connecting parts are arranged on non-coplanar connecting surfaces of said second connecting base.

8. The bobbin according to claim 7, wherein said connecting surfaces are arranged in multiple steps.

9. The bobbin according to claim 7, wherein said connecting surfaces are alternate concave and convex surfaces.

* * * * *